US006454917B1

(12) United States Patent
Lin

(10) Patent No.: US 6,454,917 B1
(45) Date of Patent: Sep. 24, 2002

(54) HIGH THROUGHPUT AND HIGH PERFORMANCE COPPER ELECTROPLATING TOOL

(75) Inventor: Bih-Tiao Lin, Ping-Tung Hsien (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 09/699,843

(22) Filed: Oct. 30, 2000

(51) Int. Cl.[7] ..... C25B 9/00; C25D 17/04

(52) U.S. Cl. ..... 204/242; 204/273; 204/297.01; 204/297.06

(58) Field of Search ..... 204/224 R, 297.06, 204/222, 279, 242, 273, 297.01

(56) References Cited

U.S. PATENT DOCUMENTS 5,264,091 A * 11/1993 Lecere et al. ..... 204/284 X
5,458,755 A * 10/1995 Fujiyama et al. ..... 204/224 R

* cited by examiner

*Primary Examiner*—Donald R. Valentine
(74) *Attorney, Agent, or Firm*—J.C.Patents

(57) ABSTRACT

An electroplating tool, which includes at least of a deposition cassette which is installed on a negative electrode and copper piece in an electroplating tank, or a copper rod is installed on the positive electrode of the electroplating room. 25 wafers are installed in the electroplating room, and both ends of each of the wafers are respectively fixed in place by a wafer clamp. The wafer clamp is in contact with the negative electrode, and is electrically connected to the wafer. The copper rod or copper piece that connects to the positive electrode can be a big piece that is installed on the outer side of the deposition cassette opening. It can also assume a comb-like arrangement of 25 pieces, respectively interlocked and extending into the gaps between the wafers. Moreover, in order to increase the even distribution during copper deposition, the present invention further adds a sound wave vibration apparatus at the bottom of and on the two sides of the electroplating tank. An ultrasonic vibration is simultaneously provided on the electroplating, causing the copper layer on the wafers in the deposition cassette to be well distributed.

17 Claims, 3 Drawing Sheets

HIGH THROUGHPUT AND HIGH PERFORMANCE COPPER ELECTROPLATING TOOL

BACKGROUND OF THE INVENTION

1. Field of the Invention

The present invention relates to an electroplating tool. More particularly, the present invention relates to a copper damascene process of an electroplating tool in a semiconductor.

2. Description of the Related Art

When the integration of the integrated circuit increases, this causes the surface of the chip to have no way of providing ample area for creation of the required internal connections. In order to fulfill the necessary requirements of the metal oxide semiconductor (MOS) transistor after it has been reduced in size, multileveled metal processing is becoming a process used more and more in an integrated circuit device. As the line width of fabrication process decreases, the current density that the metal line withstands is increasingly high. Conventionally, when the metal line is primarily formed of aluminum, the metal line is influenced by the electron migration (EM) effect, and thus lowers the reliability of the device. Moreover, along with the gradual reduction of the metal line, the resistance of the metal line also increases correspondingly. In order to solve the above-described problems encountered by the semiconductor device when it enters deep submicron processing, the minimal use of EM and the low resistance of copper become a consistent choice of semiconductor device manufacturers.

The many advantages of applying copper in the processing of the metal interconnections are such that copper has low resistance, a high melting point, and a high EM resistance. Moreover, the internal line circuit of copper improves the operation rate of the chip. By contrast to aluminum, copper interconnections provide an operation speed twice as high. Since using a metal damascene process to form a copper interconnection structure not only lowers the RC delay rate, but also lowers the electrostatic capacity between the copper interconnections. Therefore, in order to raise the integration and the conduction of the device, copper is the material of choice in the formation of metal interconnection structures.

However, since an etching gas does not easily etch copper, copper conductive wire processing cannot be completed through a conventional processing method. Consequently, a metal damascene process is provided to solve this problem.

In the metal damascene processing, an interconnection is formed by first etching the dielectric layer to form an opening, and then filling the opening with a metal. Since the metal damascene process can fulfill the requirement of having a high reliability and high efficiency during interconnection processing, this process has already become the most preferable choice in a deep submicron interconnection processing.

During the processing of copper interconnections in the related art, through physical vapor deposition (PVD), a thin conformal copper grain layer is formed to cover the openings of the dielectric layer hole. Electroplating is used to form a copper layer, thereafter chemical mechanical polishing (CMP) is used to remove the copper layer that is outside the filled openings and higher than the dielectric layer. Since the quality of copper is rather soft, and the copper layer formed in the related in art is not distributed evenly. Thus, when performing CMP, dishing occurs and causes surface irregularity.

Furthermore, when the copper layer electroplating is performed in the related art, there is only one wafer in each electroplating tool. Hence, manufacturing all of the wafers requires a relatively long period of time. Not only is the manufacturing productivity unable to increase, but also, the production costs increase correspondingly.

SUMMARY OF THE INVENTION

In view of the above, the present invention is to provide an electroplating tool. During electroplating of the copper layer, a batch-type deposition procedure is used to replace the single-wafer-type deposition procedure. Since there are 25 wafers in each batch, thus, the manufacturing productivity increases.

The present invention provides an electroplating tool that includes at least a deposition cassette that is installed in the negative electrode of the electroplating tank, and the copper piece or copper rod is installed in positive electrode of the electroplating room. 25 wafers can be installed in the electroplating room, and each side of the wafer is respectively fixed in place by a wafer clamp. The wafer clamp and negative electrode are connected to each other, and are in electric contact with the wafers. Moreover, the copper rod or copper piece that connects to the positive electrode is a big piece installed on the outside of the opening of the wafer clamp. It can also be made of a comb-like arrangement of 25 copper pieces, respectively interlocked and extending into the gaps between the wafers.

When performing electroplating, the surrounding wafers electrically influence the wafers located in the central portion of the wafer clamp. Thus, the deposition effect is evenly distributed amongst the wafers in the upper portion and on the bottom of the deposition cassette. In order for the deposition effect of each wafer to be uniform, a relatively large voltage is needed to be applied on 1 to 4 wafers located in the upper portion and the lower portion of the deposition cassette. That is, the voltage that is applied on the wafers located in the upper portion and the lower portion of the deposition cassette is 1 to 5 volts greater than the voltage applied on the central wafers.

Moreover, in order to increase the even distribution during copper deposition, the present invention further adds a sound wave vibration apparatus on the bottom and on the two sides of the electroplating tank. Simultaneously, an ultrasonic vibration is provided on the electroplating, thereby causing the copper layer deposited on the wafer to be relatively well distributed.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention, and, together with the description, serve to explain the principles of the invention. In the drawings.

DESCRIPTION OF THE PREFERRED EMBODIMENTS

Figure 1:
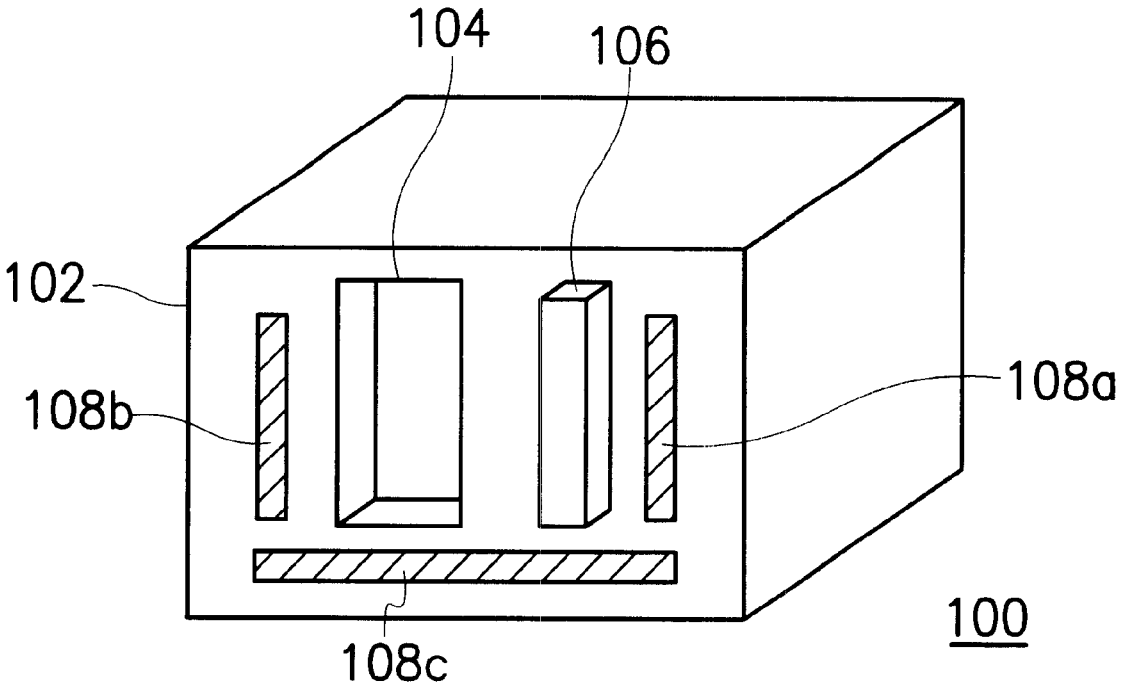
FIG. 1 is a diagram according to one preferred embodiment of this invention.

FIG. 1 is a diagram of a first preferred embodiment of the present invention.

As shown in the illustration, the present invention provides an electroplating tool 100, including an electroplating tank 102, a deposition cassette 104, a metal piece 106 and sound wave vibration apparatuses 108*a,* 108*b* and 108*c*. The deposition cassette 104 assumes a rectangular shape, and is used to install the desired wafer (not illustrated), in depositing a metal layer thereon. The deposition cassette has a longitudinal axis, an unpper portion, a certral portion, and a lower portion. Each wafer is electrically connected to the negative electrode respectively, and the electroplating solution has metal ions that are the same as the electroplating metal. In the embodiment of the present invention, a batch of wafers can be installed in the deposition cassette 104 simultaneously, which is 25 wafers, as opposed to deposition one-by-one in the related art, thus greatly increasing productivity.

The metal piece 106 has a longitudinal axis and is located in the electroplating tank for electrically coupling to the positive electrode. The longitudinal axis of the metal piece is parallel with the longitudinal axis. Thus, when performing electroplating deposition, the copper ions that supplemented the electroplating can be released. The metal plate 106 is installed onto the side of the opening of the deposition cassette 104. Also, the sound wave vibration apparatuses 108*a,* 108*b,* and 108*c* are used to further even the distribution of the ions in the electroplating solution, and to further enhance the even distribution of deposited metal on the wafer. For example, when deposited metal is copper, the metal piece 106 that is used is a copper piece, and the electroplating solution includes copper ions.

Figure 2A:
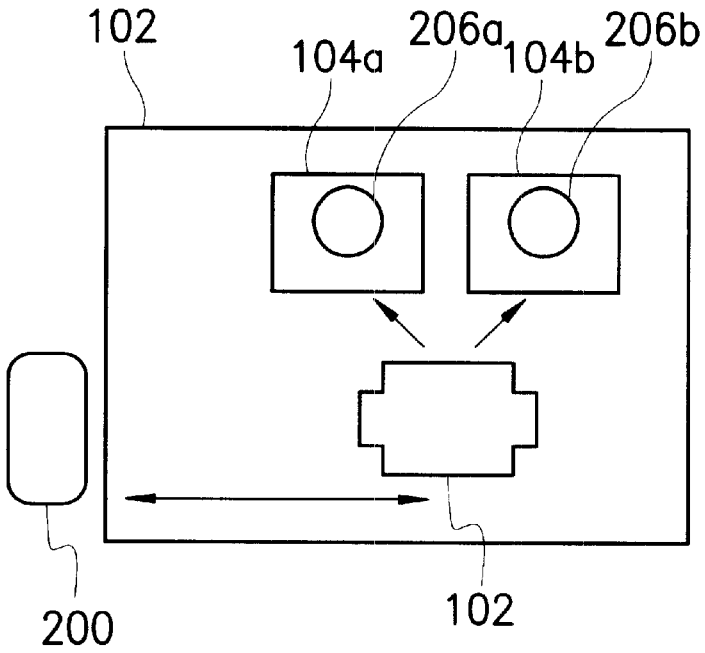
FIGS. 2A and 2B are diagrams in top view and side view, respectively, illustrating the electroplating tool in FIG. 1.
Figure 2B:
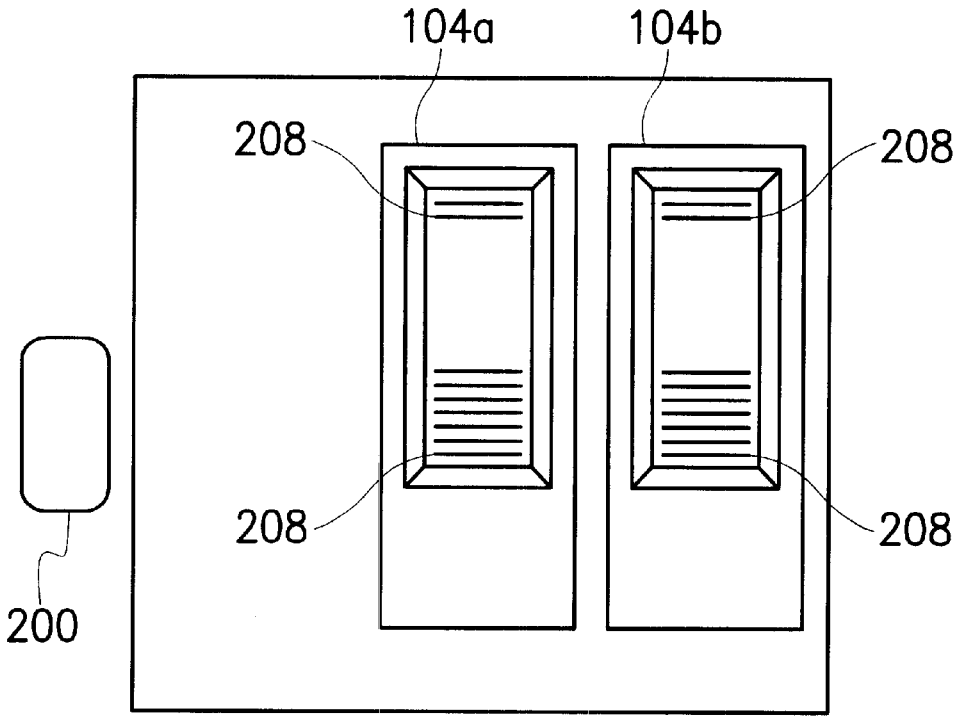

FIG. 2A and 2B are diagrams in top view and the side view, respectively, of the electroplating tool in FIG. 1.

When performing electroplating, each of the wafers 208 in the entire batches 206*a* and 206*b* is first transmitted from a general wafer boat 200 into the deposition cassette 104. A mechanical arm 202 performs the transmission process. The deposition cassette 104 further includes a first deposition cassette 104*a* and a second deposition cassette 104*b*. Each of the deposition cassettes 104*a* and 104*b* includes a batch of wafers 206*a* and 206*b*. After each of the wafers 108 have been fixed into the deposition cassettes 104*a* and 104*b,* the deposition cassettes 104*a* and 104*b* are transmitted to the electroplating tank 102 that is full of electroplating solution. The openings of the deposition cassettes 104*a* and 104*b* and the metal piece face each other (see FIG. 1).

Figure 3A:
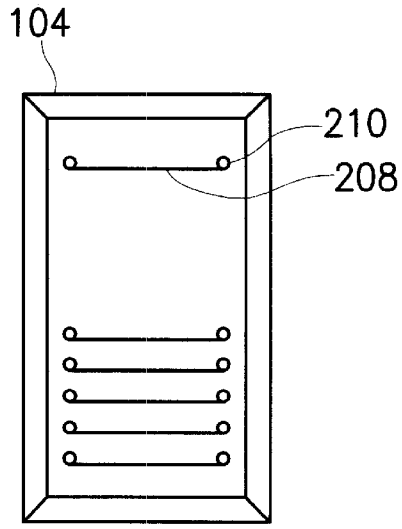
FIGS. 3A and 3B are diagrams in side view and top view, respectively, illustrating the deposition cassette in detailed description.
Figure 3B:
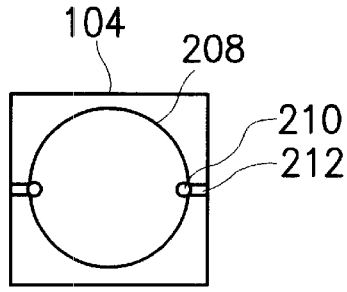

FIG. 3A and 3B are diagrams in side view and top view, respectively, of the deposition cassettes 104*a* and 104*b* of the deposition cassette 104 described in detail in FIG. 2. In the deposition cassette 104, each of the wafers 208 is better held in place by a fixed clamp 210. Each of the wafers 208 passes through the fixed clamp 210 via the negative electrode 212 to make an electrical connection. Thus, the material of the fixed clam 210 must be a conductive material.

Figure 4:
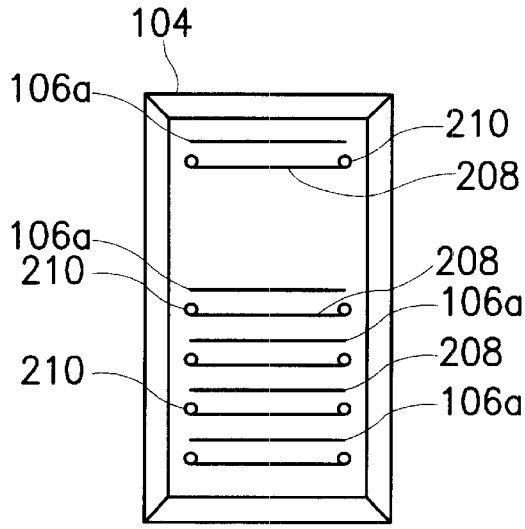
FIG. 4 is a diagram illustrating a metal piece used as a metal electroplating source of the electroplating tool in the present invention.

FIG. 4 is a diagram illustration the use of a metal piece as an electroplating source in the present invention of an electroplating tool. The electroplating deposition source of the present invention, as described in FIG. 1, is the metal piece 106 installed on the side of the opening of the deposition cassette 104. Moreover, the present invention can also use a metal board as an electroplating deposition source. As illustrated in FIG. 4, each of the metal boards 106*a* extends from a side of the opening of the deposition cassette 104 towards the inside of the deposition cassette 104, thereby causing the metal boards 106*a* and wafers 108 to be alternatively distributed. When electroplating is performed in this way, the distance for movement between the metal ions is shortened.

In the present invention, each of the deposition cassettes 104*a* and 104*b* has a capacity for a batch of wafers 208, which means 25 wafers. Each of the wafers is held in place by the fixed clamp and is electrically connected to the negative electrode. When performing electroplating, the voltage passes through the negative electrode and is applied on the wafer, thereby causing the metal ions in the electroplating solution to deposit on the wafers. Since the lower portion of the wafers located in the central portion of the deposition cassette are surrounded by wafers, thus, the ability to attract metal ions is higher than the wafers distributed on the upper portion and on the bottom of the deposition cassette.

In view of the above, the ability of the wafers to attract metal ions is needed to be close. Owing to a difference in the position of the wafers, the voltages applied on the wafers located in the upper portion and lower portion of the deposition cassette are greater than the voltages applied on the wafers located in the central portion. Thus, in the present invention, from top to bottom, the wafers are sequentially numbered 1 to 25, for example. Electric voltages are applied on wafers 1 to 4 and 22 to 25, and a higher voltage is applied on wafers 5 to 21, with a difference in voltage value of approximately 1 to 5 volts.

The voltage value used must be adjusted according to actual situation. For example, during electroplating, the deposition cassette is not yet entirely filled with wafers, which means that wafers have not been installed onto the upper portion and the bottom portion of the deposition cassette. Since the numbers of the electroplating wafers are relatively low and quite concentrated, the voltage difference between the upper and lower wafers and the central wafers is less than the voltage used in filling up the wafers.

The present invention provides an electroplating tool, and the deposition cassette is able to simultaneously accommodate a batch of wafers. Consequently, it performs metal electroplating one batch of wafers at a time, in contrast to the related art that performs the electroplating one wafer at a time. The present invention of an electroplating tool thus greatly increases productivity.

Moreover, in the present invention of an electroplating tool, a sound wave vibration apparatus is installed surrounding the deposition cassette and the metal piece. This causes the metal ions in the electroplating solution to be evenly distributed. By increasing the even distribution of the deposited metal on the wafer, it makes a great contribution towards raising the quality of the deposited metal.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electroplating tool comprising:

an electroplating tank for containing an electroplating solution;

a deposition cassette for containing a plurality of wafers to be electroplated and located in said electroplating tank, wherein said deposition cassette has a longitudinal axis, an upper portion, a central portion, and a lower portion;

a negative electrode for electrically coupling with a plurality of wafer to be electroplated;

a metal piece having a longitudinal axis and located in said electroplating tank for electrically coupling to a positive electrode, wherein said longitudinal axis of said metal piece is parallel with said longitudinal axis of said deposition cassette.

2. The electroplating tool as claimed in claim 1, wherein the deposition cassette further comprises a plurality of fixed clamps for holding the wafers in place in the deposition cassette.

3. The electroplating tool as claimed in claim 1, wherein the metal piece is copper.

4. The electroplating tool as claimed in claim 1, wherein the electroplating tank for containing the electroplating solution is adapted to include a copper ion solution.

5. The electroplating tool as claimed in claim 1, wherein a wafer arranged for location in said central portion of said deposition cassette is adapted to have a voltage applied through the negative electrode lower than a voltage applied through said negative electrode to a wafer arranged for location in said upper and lower portions of said deposition cassette.

6. The electroplating tool as claimed in claim 5, wherein the first four wafers adapted to be in said upper portion and the last four wafers of said lower portion of said deposition cassette are adapted to have the voltage applied through said negative electrode higher than the voltage applied through said negative electrode to the rest of the wafers arranged to be in said central portion of said deposition cassette.

7. The electroplating tool as claimed in claim 6, wherein the first four wafers adapted to be in the upper portion and the last four wafers adapted to be in the lower portion of said deposition cassette are adapted to have the voltage of about 1 to 5 volts.

8. The electroplating tool as claimed in claim 1, wherein the deposition cassette is adapted to have about 25 wafers installed therein.

9. An electroplating tool, comprising:

an electroplating tank for containing an electroplating solution;

a deposition cassette for containing a plurality of wafers to be electroplated and located in said electroplating tank, wherein said deposition cassette has a longitudinal axis, an upper portion, a central portion, and a lower portion;

a negative electrode for electrically coupling with a plurality of wafer to be electroplated;

a metal piece having a longitudinal axis and located in said electroplating tank for electrically coupling to a positive electrode, wherein said longitudinal axis of said metal piece is parallel with said longitudinal axis of said deposition cassette and the metal piece further includes a plurality of metal boards, respectively extending into the deposition cassette, and is alternatively arranged for distribution amongst the wafers.

10. The electroplating tool as claimed in claim 9, wherein further comprising a plurality of sound wave vibration apparatuses, respectively installed surrounding the metal piece and the deposition cassette.

11. The electroplating tool as claimed in claim 9, wherein the wafers are adapted to be respectively fixed in place by a fixed clamp in the deposition cassette.

12. The electroplating tool as claimed in claim 9, wherein the metal piece is made of copper.

13. The electroplating tool as claimed in claim 9, wherein the electroplating tank for containing the electroplating solution is adapted to include a copper ion solution.

14. The electroplating tool as claimed in claim 9, wherein the deposition cassette is arranged to have about 25 wafers installed therein.

15. The electroplating tool as claimed in claim 9, wherein a wafer adapted for location in said central portion of said deposition cassette is adapted to have a voltage applied through the negative electrode lower than a voltage applied through said negative electrode to a wafer adapted for location in said upper and lower portions of said deposition cassette.

16. The electroplating tool as claimed in claim 15, wherein the first four wafers adapted to be in said upper portion and the last four wafers of said lower portion of said deposition cassette are adapted to have a voltage applied through said negative electrode higher than a voltage applied through said negative electrode to the rest of the wafers adapted to be in said central portion of said deposition cassette.

17. The electroplating tool as claimed in claim 16, wherein the first four wafers adapted to be in the upper portion and the last four wafers adapted to be in lower portion of said deposition cassette are adapted to have the voltage of about 1 to 5 volts.

* * * * *